US005451041A

United States Patent [19]

Greive

[11] Patent Number: 5,451,041

[45] Date of Patent: Sep. 19, 1995

[54] SHEET FEEDER OF A PRINTING PRESS

[75] Inventor: Martin Greive, Heidelberg, Germany

[73] Assignee: Heidelberger Druckmaschinen AG, Heidelberg, Germany

[21] Appl. No.: 239,216

[22] Filed: May 6, 1994

[30] Foreign Application Priority Data

May 6, 1993 [DE] Germany ..... 43 14 971.5

[51] Int. Cl.[6] ..... B65H 3/14

[52] U.S. Cl. ..... 271/98; 271/104; 271/106; 271/169

[58] Field of Search ..... 271/98, 104, 106, 167, 271/169

[56] References Cited

U.S. PATENT DOCUMENTS

| | | | |
|---|---|---|---|
| 1,505,349 | 8/1924 | Johnson et al. | 271/167 |
| 3,411,640 | 11/1968 | Wallis | 271/104 X |
| 3,635,464 | 1/1972 | Gramlich . | |
| 4,089,516 | 5/1978 | Colglazier et al. | 271/169 X |
| 4,678,175 | 7/1987 | Arldt et al. | 271/169 X |
| 4,690,394 | 9/1987 | Maul et al. . | |

FOREIGN PATENT DOCUMENTS

| | | | |
|---|---|---|---|
| 0339265 | 11/1989 | European Pat. Off. . | |
| 6602324 | 2/1968 | Germany . | |
| 1816491 | 7/1971 | Germany . | |
| 2816430 | 5/1984 | Germany . | |
| 8406329.7 | 5/1984 | Germany . | |
| 3446862 | 7/1986 | Germany . | |
| 3472276 | 6/1989 | Germany | 271/169 |
| 3816804 | 2/1991 | Germany . | |
| 9203298.2 | 7/1992 | Germany . | |
| 140444 | 11/1980 | Japan | 271/104 |
| 123049 | 5/1990 | Japan | 271/104 |
| 2111024 | 6/1983 | United Kingdom | 271/104 |
| 2247879 | 3/1992 | United Kingdom | 271/106 |
| 89/03798 | 5/1989 | WIPO . | |

*Primary Examiner*—H. Grant Skaggs
*Assistant Examiner*—Carol L. Druzbick
*Attorney, Agent, or Firm*—Herbert L. Lerner; Laurence A. Greenberg

[57] ABSTRACT

Sheet feeder of a printing press having suckers for seizing an uppermost sheet of a sheet pile at a leading end of the uppermost sheet, at least one sheet-pile stop having an upper edge over which the uppermost sheet is liftable, and a pair of transport rollers to which the uppermost sheet is feedable includes grooves formed in the sheet-pile stop and extending parallel to leading and trailing edges of the sheets on the sheet pile.

4 Claims, 4 Drawing Sheets

SHEET FEEDER OF A PRINTING PRESS

SPECIFICATION

The invention relates to a sheet feeder of a printing press and, more particularly, to such a sheet feeder wherein an uppermost sheet of a sheet pile is seized at a leading end thereof by suckers, lifted over an upper edge of at least one pile stop and fed to a pair of transport rollers.

Sheet feeders of this type are in common use and have become known heretofore, for example, from German Utility Model 84 06 329. For a precise alignment of the sheet pile, several fixed sheet-pile stops are generally provided against which the sheet pile abuts, due to its own force of gravity, on the side thereof facing towards the printing press and is slidingly moved, when the sheet pile moves upwardly so as to adjust to the pile height which decreases due to the feeding of the sheets from the pile.

Accordingly, the sheet pile is provided with a smooth contact surface. In an upper region of the sheet pile, blowing-air nozzles or an air bar with blowing-air outlets are provided for loosening the sheet pile prior to separating the sheets and, in addition thereto, so-called separator springs are provided having respective angularly bent upper ends which somewhat embrace the sheet pile in order to facilitate the individual separation or singling of the sheets which often adhere to one another at respective cutting edges thereof. Instead of such separator springs, other means comparable in the effect thereof, such as stripper lugs or vanes formed of elastic plastic material according to German Patent 18 16 491 may also be used.

It is an object of the invention to provide sheet feeders of the type mentioned in the introduction hereto wherein the individual separation or singling of sheets while the sheets are being successively lifted from the sheet pile is considerably improved upon.

With the foregoing and other objects in view, there is provided, in accordance with the invention, a sheet feeder of a printing press having suckers for seizing an uppermost sheet of a sheet pile at a leading end of the uppermost sheet, at least one sheet-pile stop having an upper edge over which the uppermost sheet is liftable, and a pair of transport rollers to which the uppermost sheet is feedable, comprising means defining grooves formed in the sheet-pile stop and extending parallel to leading and trailing edges of the sheets on the sheet pile.

With these features it is possible to increase sheet-separating or singling reliability in a very simple and inexpensive manner.

In accordance with another feature of the invention, the grooves are formed with sharp-edged boundaries.

In contrast with the conventional notion that the contact surface of the sheet pile be made as smooth as possible, the grooves extending parallel to the sheet edges produce stop or impact edges of relatively little height for the sheet edges, so that the following sheet is retained at such a stop edge when the uppermost sheet is being lifted.

In accordance with a further feature of the invention, the grooves are respective shallow flutes.

Thus, grooves having relatively little depth but sharp-edged boundaries are preferably used because they are favorable for attaining the desired effect. Flutes of relatively little depth serve the same purpose.

In accordance with a concomitant feature of the invention, the sheet feeder includes other sheet-pile stops, the one and the other sheet-pile stops being in an alternating arrangement with separator springs and air outlets of a blower bar disposed in front of and along the leading edge of respective upper sheets of the sheet pile.

The desired effect may be attained even by means of only one stop, and certainly with a plurality of stops in accordance with the construction of the invention. Nevertheless provision is also made for stops with grooves or the like extending parallel to the leading and trailing edges of the sheets of the sheet pile and alternating with separator springs and air outlets of a blower bar disposed in front of the sheet pile. Thus, several stop bars or rails with transversely extending grooves are distributed over the width of the sheet pile.

Other features which are considered as characteristic for the invention are set forth in the appended claims.

Although the invention is illustrated and described herein as embodied in a sheet feeder of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
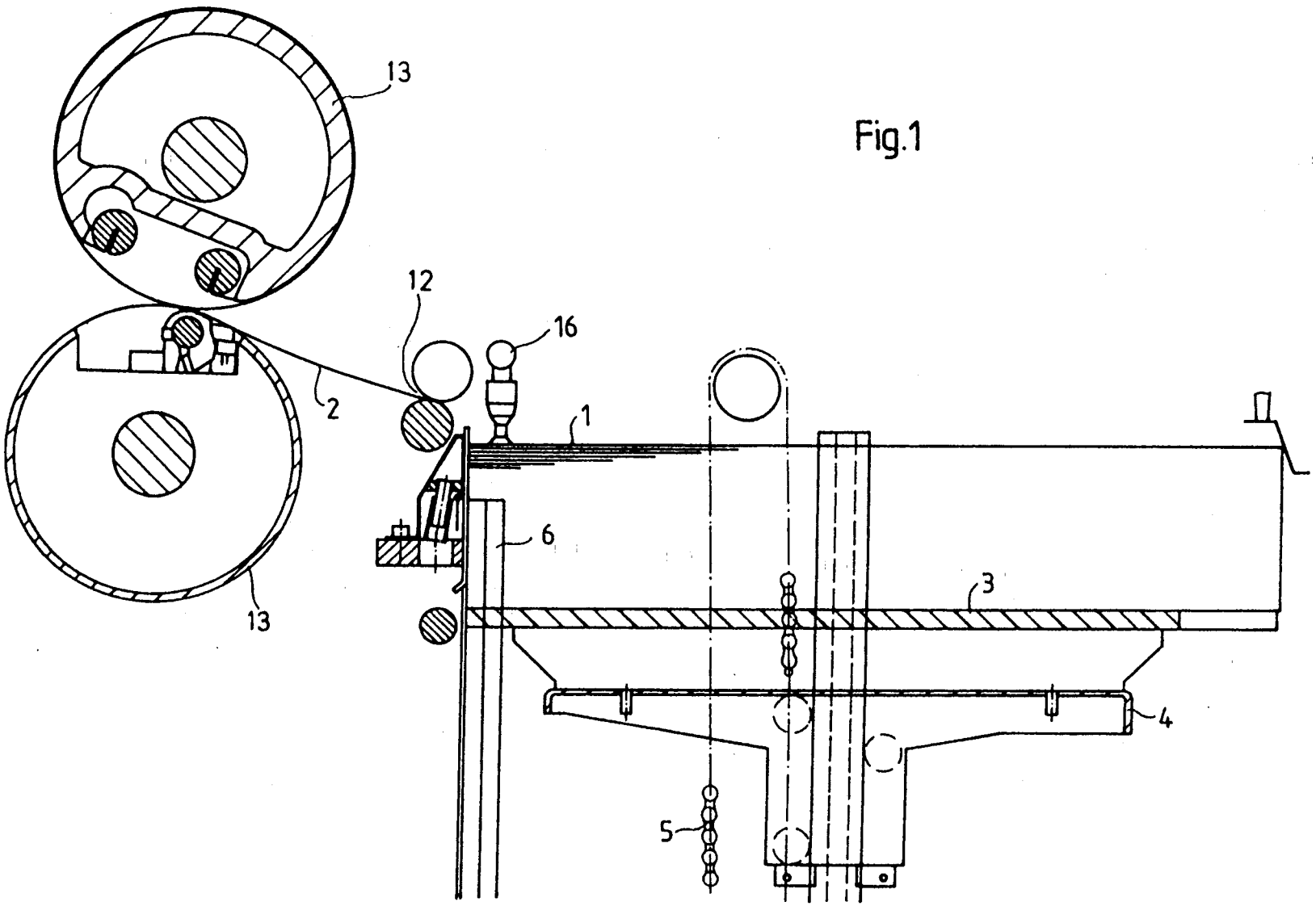
FIG. 1 is a longitudinal sectional view of a sheet feeder constructed in accordance with the invention.
Figure 2:
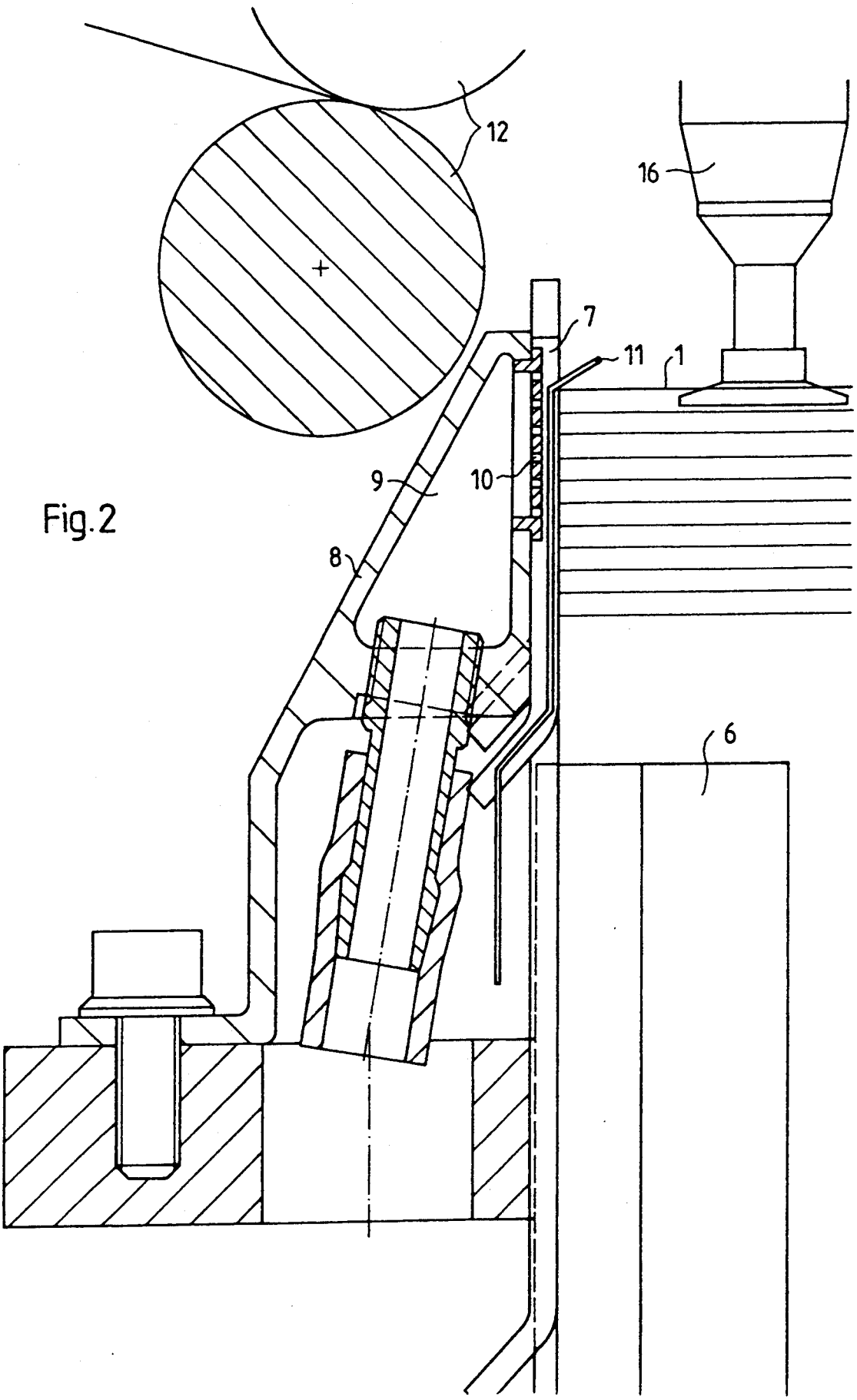
FIG. 2 is an enlarged fragmentary view of FIG. 1.
Figure 3:
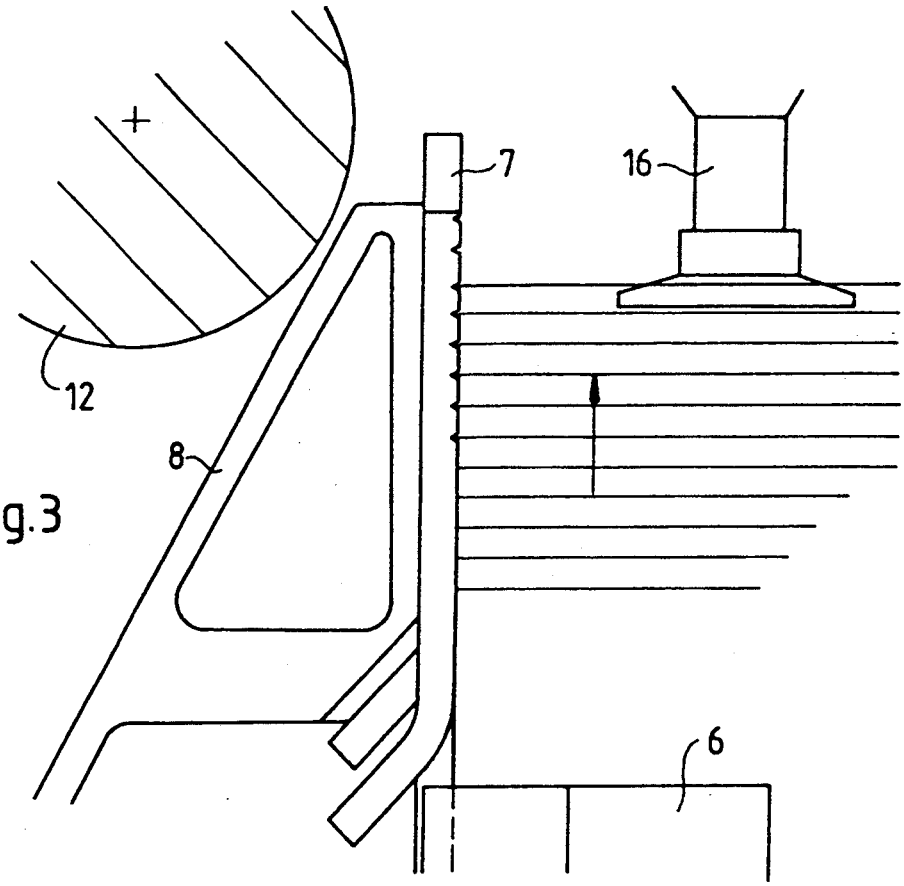
FIG. 3 is a fragmentary side elevational view of FIG. 2.
Figure 4:
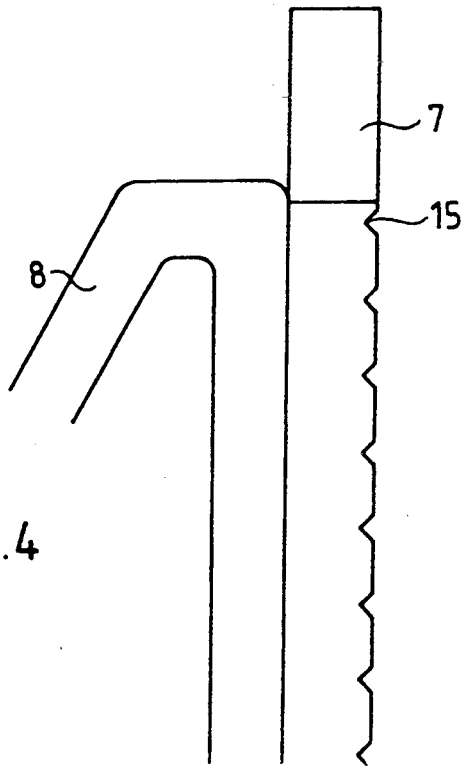
FIG. 4 is an enlarged fragmentary view of FIG. 3 showing a stop rail or bar thereof.
Figure 6:
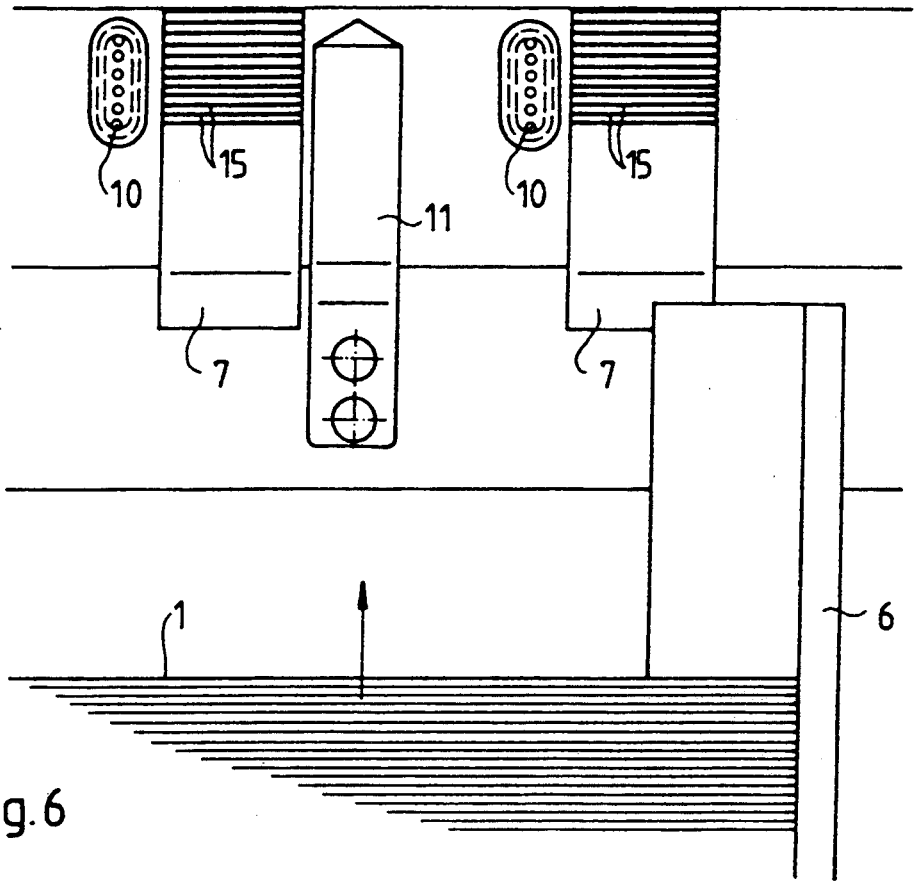
FIG. 6 is an enlarged fragmentary view of FIG. 5.
Figure 5:
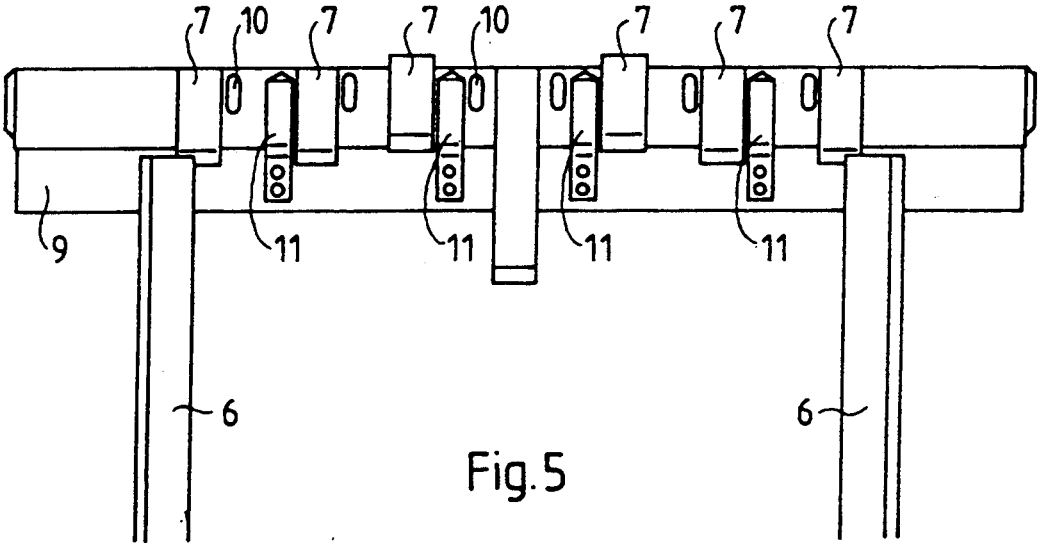
FIG. 5 is a front elevational view of a blower bar of the sheet feeder with sheet pile stops and separator springs attached thereto as seen from the right-hand side of FIG. 1 with the sheet pile removed.

Referring now to the drawings and, first, particularly, to FIGS. 1 and 2 thereof, there is shown therein a sheet pile 1 formed of individual sheets 2 resting on an inclined pile support or pile board 3 of a pile table 4 which, by means of a chain 5, is connected to a non-illustrated conventional lifting unit so that the height of the sheet pile 1 may be raised in order to adjust to or match the decreasing sheet-pile height. In this regard, the sheet pile 1 is guided in lateral pile guides 6. The sheet pile 1, at an end thereof facing towards the printing press, abuts sheet-pile stops 7 which, in a spaced-apart relationship from one another, are fixed on a housing 8 of a blower bar 9 (FIG. 2). Air outlets 10 of the blower bar 9 are disposed between the sheet-pile stops 7. Moreover, elastic and flexible separating springs 11 shown in greater detail in FIGS. 5 and 6 are provided between the sheet-pile stops 7. At its front end, the sheet pile abuts the sheet-pile stops 7. The respective uppermost sheet is seized by a movably arranged sucker 16, and lifted by the respective leading edge thereof over the sheet-pile stops 7, and then the sheet is fed to a pair of transport rollers 12 which convey the sheet 2 into the nip between the cylinders 13 of a printing press or the like. In order to increase the reliability of separating the lifted uppermost sheet from the next sheet on the sheet pile, the contact surfaces of the sheet-pile stops 7 are provided with grooves 15 extending parallel to the edges of the sheets of the sheet pile and having boundaries which are as sharp-edged as possible so that the following sheet is retained at the edge of a groove, flute or the like by means of the transport sucker 16, when the uppermost sheet is being lifted from the sheet pile. FIGS. 3 and 4 show in greater detail the appearance of the grooves 15 or the like provided in the contact surface of the sheet-pile stops 7. The enlarged representation in FIG. 4 is somewhat distorted; however, it clearly shows the sharp-edged formation of the grooves 15, flutes or the like.

I claim:

1. Sheet feeder of a printing press, comprising suckers for seizing an uppermost sheet of a sheet pile at a leading end of the uppermost sheet, at least one sheet-pile stop oriented substantially perpendicular to the sheets of the sheet pile and having an upper edge over which the uppermost sheet is liftable, and a pair of transport rollers to which the uppermost sheet is feedable, said sheet-pile stop having grooves formed therein extending parallel to leading edges of the sheets on the sheet pile; including other sheet-pile stops, the one and the other sheet-pile stops being in an alternating arrangement with separator springs and air outlets of a blower bar disposed in front of and along the leading edge of respective upper sheets of the sheet pile.

2. The sheet feeder according to claim 1, wherein said grooves are cut into said sheet-pile stop with sharp-edged boundaries.

3. The sheet feeder according to claim 1, wherein said grooves are shallow flutes.

4. The sheet feeder according to claim 1, wherein said grooves have a given width and wherein respective ones of said grooves are spaced from one another at a distance which is greater than the given width of the grooves.

* * * * *